US005947557A

United States Patent [19]

Bellefleur

[11] Patent Number: 5,947,557

[45] Date of Patent: Sep. 7, 1999

[54] ROCKING CHAIR

[75] Inventor: Pierre Bellefleur, Magog, Canada

[73] Assignee: Dutailier International Inc., St. Pie, Canada

[21] Appl. No.: 08/874,708

[22] Filed: Jun. 13, 1997

[51] Int. Cl.[6] ..... A47C 3/026; A47D 13/10

[52] U.S. Cl. ..... 297/281; 297/282; 297/259.3; 297/411.2

[58] Field of Search ..... 297/280, 281, 297/282, 258.1, 344.11, 273, 259.3, 411.2; 248/370

[56] References Cited

U.S. PATENT DOCUMENTS

| | | | |
|---|---|---|---|
| 2,079,767 | 5/1937 | Larsen | 248/370 |
| 2,179,395 | 11/1939 | Yerrick | 297/281 |
| 2,683,481 | 7/1954 | Lorenz | 297/344.11 |
| 3,414,325 | 12/1968 | Jutila | 297/281 |
| 4,536,029 | 8/1985 | Rogers, Jr. . | |
| 4,591,205 | 5/1986 | James . | |
| 4,700,920 | 10/1987 | Horn . | |
| 4,790,599 | 12/1988 | Goldman | 297/282 |
| 4,861,106 | 8/1989 | Sogdergeld . | |
| 5,427,433 | 6/1995 | Holobaugh, Jr. . | |

FOREIGN PATENT DOCUMENTS

| | | |
|---|---|---|
| 9308716 | 5/1993 | WIPO . |

*Primary Examiner*—Peter M. Cuomo
*Assistant Examiner*—Anthony D. Barfield
*Attorney, Agent, or Firm*—Ladas & Parry

[57] ABSTRACT

A rocking chair comprising a rocking mechanism that is concealed in the armrests of the chair. More specifically, each armrest includes an upper surface on which the user can place his arm and sidewalls depending from the upper surface. The sidewalls define between them a cavity of sufficient dimensions to receive the rocking mechanism. The armrests are connected to the back and the seat of the chair, so as to move with those components when a rocking movement is imparted to the chair.

10 Claims, 2 Drawing Sheets

ROCKING CHAIR

FIELD OF THE INVENTION

The present invention relates to rocking chairs.

BACKGROUND OF THE INVENTION

Rocking chairs are chairs which are designed so as to allow the person sitting in them to gently rock or sway to and fro under their own power. Most people find such chairs comfortable to sit and their movement very relaxing. Rocking chairs have been in existence for quite a number of years, and remain quite popular.

Despite their age, two early rocking chair designs are still the most common today. The first of these designs is the typical rocking chair which generally comes to mind when the term is heard or discussed. It is a more or less standard (generally wooden) chair comprising a back, seat and legs and having two rockers, i.e. arcuate ground-engaging members attached to the bottom of the legs on which the chair is supported and about which the chair may be rocked.

The second design might be more commonly referred to as a swinging chair. Chairs of this design are generally bench-like (i.e. generally comprise a back, seat and armrests) and are pivotably suspended from a vertical surface above the chair vias ropes or chains. As with their cousins of the first design, these chairs are also capable of a rocking or swinging movement, albeit about their point of attachment to the overhead vertical surface.

While such designs are popular they are not without some drawbacks. Chairs of the first design are not affixed to the ground (or any other) surface and thus are capable of movement across the ground surface on which they sit when they are being rocked. Such type of movement is undesirable and may be hazardous depending on the environment in which the chair is located (e.g. a porch, etc.) Moreover, such chairs may present a hazard to small children, animals, or objects which may get underneath one of the rockers and crushed. In addition, such chairs may tip over if strenuously rocked.

Chairs of the second type have their own drawbacks. Primarily, they sway easily and are difficult for the young, elderly and infirm to get onto or out of. Moreover they require some effort to bring and maintain the swinging motion. They are typically large and cumbersome. Finally, while not generally a common occurrence, they may be pulled out of their point of anchoring to the overhead vertical surface or one of the ropes or chains from which they are suspended may break, in either case causing the chair to fall with obvious undesirable consequences.

To overcome some of these difficulties improvements upon these designs have been put forth. An example of such an improved rocking chair design is described in International Patent Application WO 93/087616 (Knowlson) published May 13, 1993. Such application descirbes a rocking or swinging chair comprising a stationary frame, a seat element supported by a seat frame and a support wherein the support is pivotally connected to and accommodated within the frame and the seat element is pivotably connected to a lower end of the support so as to be capable of reciprocating movement relative to the frame and further comprising arms pivotally connected at an upper end of the support, said armrests being capable of reciprocating movement relative to the frame in the respective opposite direction to the seat element.

The rocking chair design described in WO 93/08716 is not itself optimal. Specifically, the reciprocating movement of the armrests thereof and that of the support/seat are in opposite directions. Hence, the movement that a user of the chair will experience is "rowing-like" in that his or her arms and body will be moving in opposite directions; a movement that is generally not desired by those wishing to rock gently back and forth as with prior rocking chair designs. Moreover, the armrests of the WO 93/08716, are not connected to the body supporting members, and there is a gasp between armrest side walls and the seat. When this chair is in use the armrest side walls will remain stationary while the seat moves. It is therefore possible that objects (including children's fingers) may become lodged in between the side walls and the seat, damaging both the chair and or the object.

Moreover, none of the conventional rocking chair designs actually appears to an observer to be a normal armchair or sitting chair. It times ti would be desirable to have a chair which is capable of a rocking or swinging movement, which would nonetheless appear like a normal armchair or sitting chair.

OBJECT AND STATEMENT OF THE INVENTION

It is therefore an object of the present invention to provide an improved rocking chair design over conventional designs.

It is a further object of the present invention to provide a rocking chair that appears to an observer to be a conventional sitting chair or armchair yet which is capable of a conventional rocking motion.

As embodied and broadly described herein the present invention provides a rocking chair comprising:

(a) a body supporting member for receiving a human body, said body supporting member including:
  (i) a back;
  (ii) a seat;
  (iii) a first armrest having a cavity therein; and
  (iv) a second armrest having a cavity therein;

(b) a base capable of resting on a ground surface;

(c) a first support connected to said base, said first support extending within the cavity of said first armrest;

(d) a linking member disposed at least in part within said first armrest, said linking member pivotably connected to said first support and pivotably connected to said body supporting member;

(e) a second support connected to said base, said second support extending within the cavity of said second armrest; and (f) a linking member disposed at least partially within said second armrest, said liking member pivotably connected to said second support and pivotably connected to said body supporting member;

whereby said body supporting element and said armrests will be capable of rocking about said supports as said linking members pivot, all the while said linking members remaining within said armrests.

The present rocking chair design thus provides an improvement over conventional designs, particularly in they may be constructed to substantially resemble conventional armchairs or sitting chairs. The rocking mechanism is substantially hidden within the armrests and is generally not viewable by an outside observer. Moreover some of the difficulties present in chairs of prior art designs have been overcome. Particularly, the present rocking chair does not have arcuate ground engaging members and therefor does not present a hazard in this respect. It can be designed so as to firmly rest on the ground surface and therefore is not susceptible of shifting position on the ground once a rocking motion has begun. Finally, it is relatively stable and is generally more easily ingressed and regressed than prior art designs.

Preferably, a rocking chair according to the present invention further comprises:

(a) a first set of linking members disposed within said first armrest, the linking members of said first set pivotably connected to said first support and pivotably connected to said first armrest; and (b) a second set of linking members disposed within said second armrest, the linking members of said second set pivotably connected to said second support and pivotably connected to said second armrest.

Generally, the support on each side of the body supporting member is attached to its corresponding armrest via two dual-pivoting linkage members. It is advantageous to provide a plurality of linking members to afford the chair grater stability and easy of movement.

Preferably, each of said armrests has:

(a) a generally horizontal surface for receiving an arm of a user of the chair; and (b) side walls extending from said horizontal surface toward the ground surface defining the cavity.

In this manner, the armrests may be made to better appear as those of conventional armchair or sitting chairs.

More preferably, the linking members remain within the armrests and are completely hidden from view by an observer. Such will be the case, for example, when the linking members are wholly contained within the cavities of the arm rests and does not imply that the supports are made as a single piece.

Preferably, the first support and the second support are structurally integral. In the context of the present specification, the term structurally integral is meant to signify that the first support and second support are different portions of a single structure.

Preferably, if desired, the chair may be provided with a swiveling base.

Other objects and features of the invention will become apparent by reference to the following description and the drawings.

BRIEF DESCRIPTION OF THE DRAWINGS

A detailed description of preferred embodiments of the present invention is provided hereinbelow with reference to the following drawings, in which.

Figure 4:
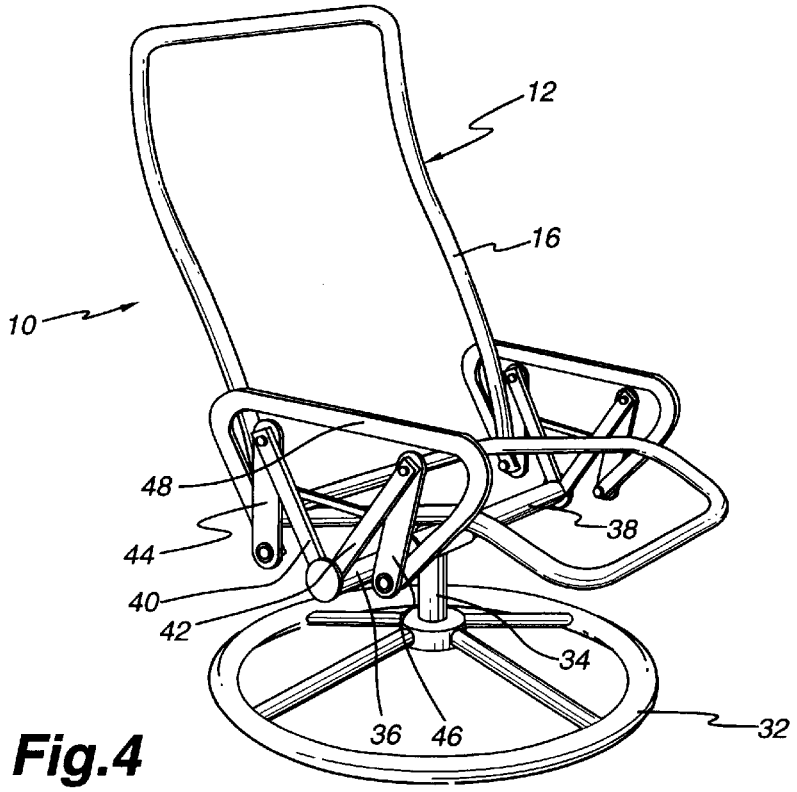
FIG. 4 is a perspective view of the rocking chair displaying the rocking mechanism thereof.
Figure 2:
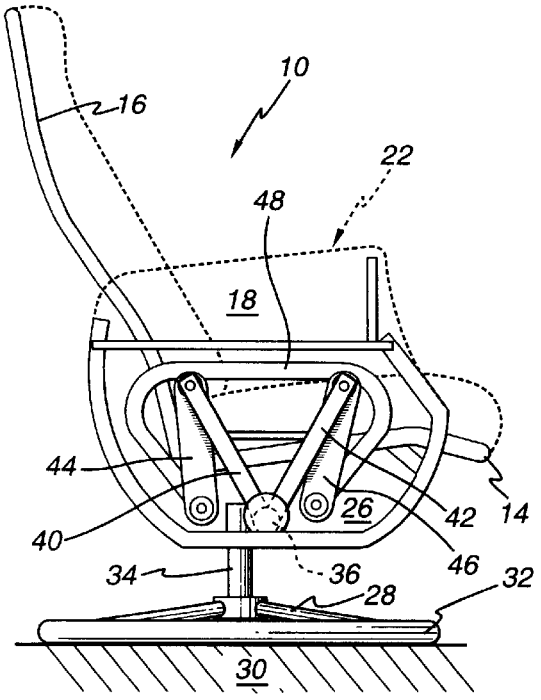
FIG. 2 is a side elevational view of the rocking chair displaying the rocking mechanism thereof.
Figure 1:
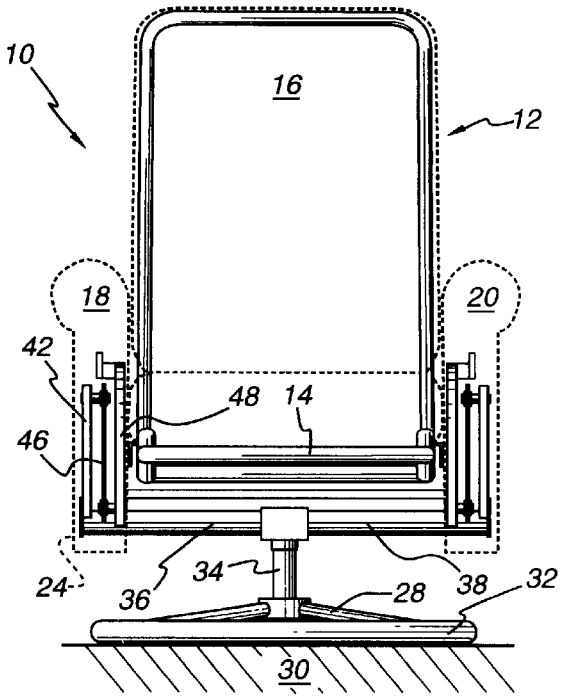
FIG. 1 is a front elevational view of a rocking chair displaying the rocking mechanism thereof.
Figure 3:
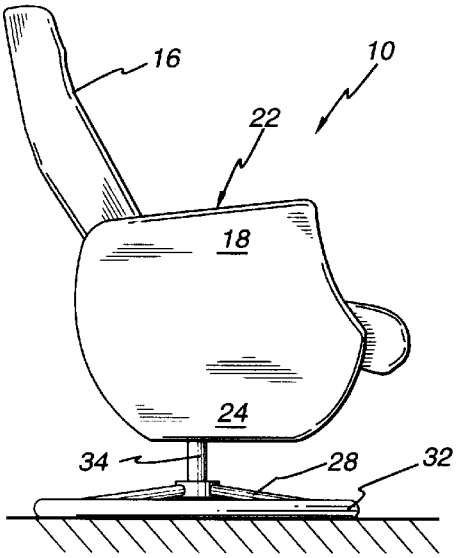
FIG. 3 is a side elevational view of the rocking chair in accordance with the present invention.
Figure 5:
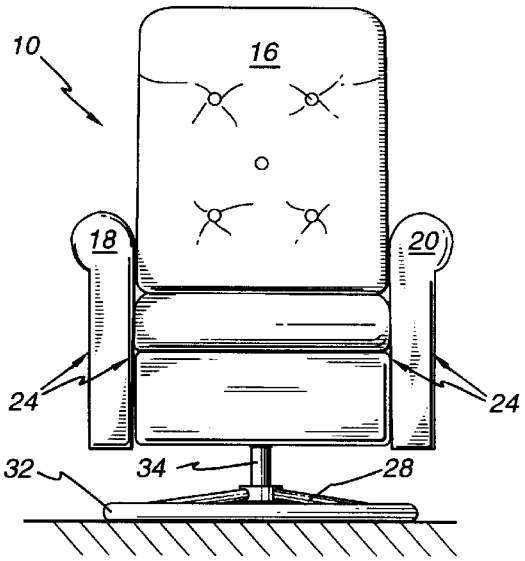
FIG. 5 is a front elevational view of the rocking chair.
Figure 6:
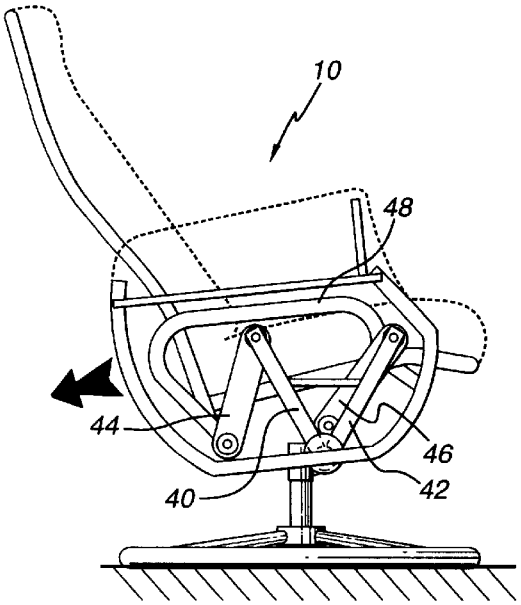
FIGS. 6 and 7 illustrate the rocking chair in different positions in the range of swinging movement thereof.
Figure 7:
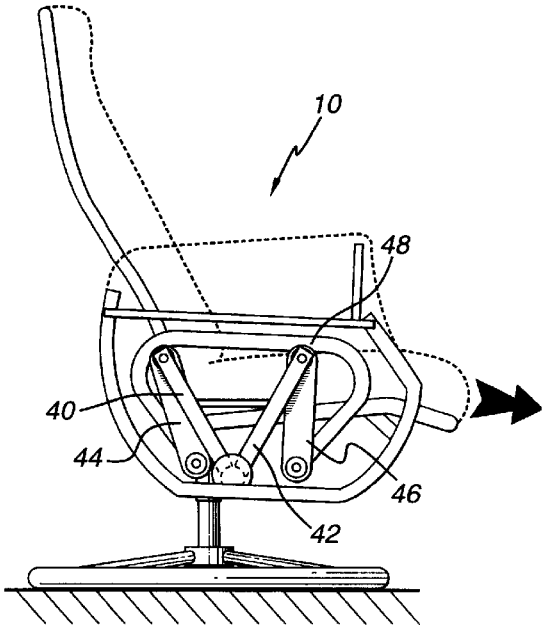

In the drawings, preferred embodiments of the invention are illustrated by way of example. It is to be expressly understood that the description and drawings are only for purposes of illustration and as aid to understanding, and are not intended to be a definition of the limits of the invention.

DETAILED DESCRIPTION OF PREFERRED EMBODIMENTS

Referring to the Figures, a rocking chair 10 of the present invention comprises a body supporting member 12 including a seat 14 and a back 16. The seat 12 and the back 14 may assume any one of a large number of appearances and constructions of conventional chairs, armchairs or sitting chairs. Generally, both will be upholstered and will have puffy portions or pillows for added comfort.

The body supporting member 12 also comprises two armrests 18, 20, one on either side thereof. Any conventional means of connection will suffice, although such will generally depend on the material of which the body supporting member 12 and the armrests 18, 20 are constructed. For example, if the body supporting member 12 and armrests 18, 20 are wooden, then nails or screws may be used. Whereas if the body supporting member 12 and armrests 18, 20 have metal components, the same may be welded together or connected with suitable fasteners.

The armrests 18, 20 are of the same construction (and are generally mirror images of one another) and thus only one will be described hereinafter. The armrests 18, 20 have a horizontal surface 22 for receiving the arm of the user of the chair 10. Extending towards the ground surface from the horizontal surface 22 are side walls 24 which form a cavity 26 in the armrest 18. The side walls 24 are joined together so that the cavity is generally not perceivable by an observer viewing the chair 10 in its normal in use position. It is intended that the armrests 18, 20 be perceived by an observer as normal armrests for the type of chair being observed; the rocking mechanism (to be described below) should not be apparent to him.

Below the body supporting member 12 is a base 28 which rests upon the ground surface 30. The base 28 is of a conventional construction dependent upon the look and appearance of the chair 10. In the drawings the base 28 comprises a ground engaging portion 32 and a beam 34 extending upwards from the ground engaging portion 32. It is to be understood however that all conventional chair bases are within the scope of the present invention and thus the base could, for example, comprise four legs. Connected to the beam 34 of the base are two supports 36, 38. In the present embodiment the supports are a single integral structure, but such is not essential. The supports 36, 38 extend from the beam underneath the seat 14 and up into the cavities of the armrests 18, 20. The supports 36, 38 may be constructed of any conventional material and in accordance with conventional techniques as long as they are capable of supporting the combined weight of the chair and most users thereof without deforming, metals such as aluminium or steel are therefore preferred. (As they are identical only one support 36 will be discussed hereinbelow.)

Once inside the cavity 26 the supports 36 extending upward in a V-shape (having two arms 40, 42). The arms 40, 42 are not viewable by an observer owing to the outer side walls 24 of the armrests 18. Pivotably connected to the ends of the v-shaped arms 40, 42 are linking members 44, 46. The linking members 44, 46 are rods which are constructed of conventional materials which are together capable of supporting the combined weight of the chair 10 and mot users thereof as well as being capable of withstanding all fores generated during the rocking of the chair, all without deforming. The linking members 44, 46 are pivotably connected to the ends of the v-shaped arms 40, 42 at one end of the linking members 44, 46. The other end of the linking members 44, 46 are pivotably connected to an inverted c-shaped flat rod 48 which is secured to armrests 18 themselves.

The lengths of the linking members 44, 46 and their points of connection with the v-shaped arms, 40, 42 of the support 36 and with c-shaped rod 48 of the armrest 18 have all been selected in accordance with mechanical engineering techniques such that when the chair 10 is resting on a ground surface 30 the seat 14 of the body supporting member 12 will be substantially parallel with the ground surface 30.

In use, a user will sit on the chair 10 with his body in contact with the body supporting member 12. He or she will then generate a rocking motion either by slightly rocking his or her body or by pushing his or her feet against the ground surface 30. This rocking motion will cause the linking members 44, 46 to pivot about their connections with both the c-shaped rod 48 of the armrests 18, 20 and the v-shaped arms 40, 42 of the support 36, 38 and will allow the chair 10 (and the user) to rock back and further.

Depending on the desired design, the length and connection points of the linking members 44, 46 may be altered such that when the user is rocking, the seat 14 will either remain parallel to the ground surface 30 throughout the course of the motion, or will be slightly inclined with respect to the ground surface 30.

The size of the cavities 26 should be large enough such that at any point in the rocking swing of the chair 10 there is enough clearance for the linking members 44, 46 the v-shaped arms 40, 42 of the support 36.

Springs (not shown) may be connected to the linking members 42, 44 to increase the amount of force necessary to generate the rocking motion to prevent unwanted moving of the chair when a user is first sitting down in the chair 10 or getting up from the chair 10.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A rocking chair comprising:

(a) a body supporting member for receiving a human body, said body supporting member including:
(i) a back;
(ii) a seat;
(iii) a first armrest having a cavity therein; and
(iv) a second armrest having a cavity therein;

(b) a base capable of resting on a ground surface;

(c) a first support connected to said base, said first support extending within the cavity of said first armrest;

(d) a first set of linking members disposed at least partially within said first armrest, the linking members of said first set being pivotally connected to said first support and pivotally connected to said first armrest;

(e) a second support connected to said base, said second support extending within the cavity of said second armrest, and (f) a second set of linking members disposed at least partially within said second armrest, the linking members of said second set being pivotally connected to said first support and pivotally connected to said second armrest.

2. A rocking chair as recited in claim 1, wherein each of said armrests has:

(a) a generally horizontally extending surface for receiving an arm of a user of the chair; and (b) side walls downsardly extending from said horizontal surface, said horizontally extended surface and said side walls defining the cavity there between.

wherein said body supporting member and said armrests will be capable of rocking about said supports as said linking members pivot, all the while said linking members remaining within said armrests.

3. A rocking chair as recited in claim 1, wherein said first support and said second support are structurally integral.

4. A rocking chair comprising:

(a) a body supporting member for receiving a human body, said body supporting member including:
(i) a back;
(ii) a seat;
(iii) a first armrest having a cavity therein; and
(iv) a second armrest having a cavity therein;

(b) a base capable of resting on a ground surface;

(c) a first support connected to said base, said first support extending within the cavity of said first armrest;

(d) a first linking member disposed at least partially within said first armrest, the first linking members being pivotally connected to said first support and pivotally connected to said first armrest;

(e) a second support connected to said base, said second support extending within the cavity of said second armrest, and (f) a second set of linking members disposed at least partially within said second armrest, the linking members of said second set being pivotally connected to said body supporting member;

wherein said linking members remain within said armrests and are completely hidden from view by an observer.

5. A rocking chair comprising:

(a) a body supporting member for receiving a human body, said body supporting member including:
(i) a back;
(ii) a seat;
(iii) a first armrest having a cavity therein; and
(iv) a second armrest having a cavity therein;

(b) a base capable of resting on a ground surface;

(c) a first support connected to said base, said first support extending within the cavity of said first armrest;

(d) a first set of linking members disposed at least partially within said first armrest, the linking members of said first set being pivotally connected to said first support and pivotally connected to said first armrest;

(e) a second support connected to said base, said second support extending within the cavity of said second armrest, and (f) a second set of linking members disposed at least partially within said second armrest, the linking members of said second support and pivotally connected to said body supporting member;

wherein said first support and said second support are movably connected to said base such that said supports are capable of angular movement about said base.

6. A rocking chair comprising:

(a) a body supporting member for receiving a human body, said body supporting member including:
(i) a back;
(ii) a seat;
(iii) a first armrest having a cavity therein; and
(iv) a second armrest having a cavity therein;

(b) a base capable of resting on a ground surface;

(c) a first support connected to said base, said first support extending within the cavity of said first armrest;

(d) a first set of linking members disposed at least partially within said first armrest, the linking members of said first set being pivotally connected to said first support and pivotally connected to said first armrest;

(e) a second support connected to said base, said second support extending within the cavity of said second armrest, and (f) a second set of linking members disposed at least partially within said second armrest, the linking members of said second support and pivotally connected to said body supporting member;

whereby said body supporting member and said armrests will be capable of rocking about said supports as said linking members pivot, all the while said linking members remaining at least partially within said armrests, said body supporting member and said armrests moving conjointly when rocking, such that said body supporting member remains fixed relative to said armrests.

7. A rocking chair as recited in claim 6, wherein said first and second supports are V-shaped.

8. A rocking chair as recited in claim 7, wherein each said V-shaped support comprises a pair of angled arms and a transverse shaft, said shaft defining the vertex of said V-shaped support.

9. A rocking chair comprising:

(a) a body supporting member for receiving a human body, said body supporting member including:

(i) a back;

(ii) a seat;

(iii) a first armrest having a cavity therein; and (iv) a second armrest having a cavity therein;

(b) a base capable of resting on a ground surface;

(c) a transverse support connected to said base, and extending from one armrest to the other;

(d) an adapter extending upwardly from and connected at the end portion of said transverse support, extending substantially with said cavity of armrest;

(e) a linking member pivotally connected at first end to said adapter, said linking member extending substantially within said cavity of said armrest, said linking member being pivotally connected at second end to said body supporting member.

10. A rocking chair as recited in claim 9, whereby said body supporting frame and said armrests move in unison.

* * * * *

UNITED STATES PATENT AND TRADEMARK OFFICE

CERTIFICATE OF CORRECTION

PATENT NO. : 5,947,557

DATED : September 7, 1999

INVENTOR(S) : BELLEFLEUR

It is certified that error appears in the above-identified patent and that said Letters Patent is hereby corrected as shown below:

| | |
|---|---|
| Column 5, line 59 | (claim 1, line 21) cancel "first" and insert --second--. |
| Column 5, line 65 | (claim 2, line 5) cancel "downsardly" and insert --downwardly--. |
| Column 6, line 18 | (claim 4, line 12) cancel "the" and insert --said--; cancel "members" and insert --member--. |
| Column 6, line 20 | (claim 4, line 14) cancel "said first arm rest" and insert --body supporting member--. |
| Column 6, line 24 | (claim 4, line 18) cancel "set of linking members" and insert --linking member--. |
| Column 6, line 25 | (claim 4, line 19) cancel "the" and insert --said second--. |
| Column 6, line 28 | (claim 4, line 21) before "body supporting" insert --second support and pivotally connected to said--. |
| Column 6, line 43 | (claim 5, line 11) cancel "set of", cancel "members" and insert --member--. |
| Column 6, line 44,45 | (claim 5, lines 12,13) cancel "the linking members of said first set" and insert --said first linking member--. |
| Column 6, line 46 | (claim 5, line 14) cancel "first armrest" and insert --body supporting member--. |

UNITED STATES PATENT AND TRADEMARK OFFICE

CERTIFICATE OF CORRECTION

PATENT NO. : 5,947,557

DATED : September 7, 1999

INVENTOR(S) : BELLEFLEUR

It is certified that error appears in the above-identified patent and that said Letters Patent is hereby corrected as shown below:

| | |
|---|---|
| Column 6, line 50 | (claim 5, line 18) cancel "set of"; cancel "members" and insert --member--. |
| Column 6, line 51 | (claim 5, line 19) cancel "the" and insert --said second--. |
| Column 6, line 52 | (claim 5, line 20) cancel "of said second support and" and insert --being pivotally connected to said second support and--. |
| Column 7, line 1 | (claim 6, line 11) cancel "set of"; cancel "members" and insert --member--. |
| Column 7, line 2 | (claim 6, line 12) cancel "the linking members of said" and insert --said first linking member--. |
| Column 7, line 3 | (claim 6, line 13) cancel "first set". |
| Column 7, line 4 | (claim 6, line 14) cancel "first armrest" and insert --body supporting member--. |
| Column 7, line 8 | (claim 6, line 18) cancel "set of"; cancel "members" and insert --member--. |
| Column 7, line 9 | (claim 6, line 19) cancel "the" and insert --said second--. |
| Column 7, line 20 | (claim 6, line 20) 'being pivotally connected to said second support" to --pivotally connected to said second support--. |

Signed and Sealed this

Fourth Day of July, 2000

*Attest:*

Q. TODD DICKINSON

*Attesting Officer*

*Director of Patents and Trademarks*